United States Patent [19]

Buisson

[11] 3,974,912

[45] Aug. 17, 1976

[54] PACKAGING USING A SHEATH FOLDED ONTO A MANDREL

[76] Inventor: Marcel Buisson, 3, Place des Halles, 28000 Chartres, France

[22] Filed: Dec. 20, 1974

[21] Appl. No.: 535,029

Related U.S. Application Data

[63] Continuation-in-part of Ser. No. 334,886, Feb. 22, 1973, abandoned.

[30] Foreign Application Priority Data

Feb. 24, 1972 France ..... 72.06211

[52] U.S. Cl. ..... 206/303; 53/124 D

[51] Int. Cl.[2] ..... B65D 85/02

[58] Field of Search ..... 206/303, 527, 525, ; 229/53; 220/65, 8; 53/390, 124 B, 124 E, 124 D

[56] References Cited

UNITED STATES PATENTS

| | | | |
|---|---|---|---|
| 2,641,102 | 6/1953 | Hall | 220/65 |
| 2,880,902 | 4/1959 | Owsen | 220/8 |
| 2,908,123 | 10/1959 | Muller et al. | 53/390 |
| 2,989,828 | 6/1961 | Ward | 53/390 |
| 3,536,192 | 10/1970 | Couper | 206/303 |
| 3,747,655 | 7/1973 | Hadtke | 229/53 |
| 3,785,406 | 1/1974 | Delmar | 206/527 |

*Primary Examiner*—William T. Dixson, Jr.
*Attorney, Agent, or Firm*—Haseltine, Lake & Waters

[57] ABSTRACT

A packaging material comprising a continuous length of flexible tubular material having a multiplicity of folds alternating at opposite ends to form concentrically superimposed layers of annular plies of the material. The superimposed layers can be staggered in the axial direction or aligned. In one embodiment, the end of the material which is closer to the outer layer is folded over the plies and extends through the interior of the inner sheath.

5 Claims, 12 Drawing Figures

PACKAGING USING A SHEATH FOLDED ONTO A MANDREL

This application is a continuation in part of application Ser. No. 334,886 filed Feb. 22, 1973 by the Applicant and now abandoned.

Packages have been known for a long time which are formed from a section of a continuous tubular sheath made of synthetic heat-sealable material for example, each pack being sealed at the bottom before filling, and at the top after filling.

Automatic machines for packaging products in packages of this type are generally extremely complicated since it is, of course, necessary that the sheath be continuously supplied and that it be opened at a precise point to allow the products to be introduced.

The latter are fed in by a chute, which is usually pivotally mounted, and is in the withdrawn position when the sheath is unfolded, is brought above the open sheath for filling, and which is then moved aside again to enable the pack to be sealed.

In addition to the delicate mechanism of this chute, the machines also include complicated precision mechanisms which ensure that the sheath is correctly guided and that it is correctly opened and split so that the chute can be inserted into it.

To simplify such machines, the use of a sheath has already been envisaged which is folded "concertina-fashion" around a chute so that the products are fed into the sheath not laterally but axially, the sheath being unfolded progressively as the products arrive.

Such an installation is unsatisfactory since it is impossible to reconcile a minimum length of chute with a maximum length of sheath in reserve. Furthermore, the sheath is required to have conflicting qualities of thinness, elasticity and strength coupled with the requirement that it be easy to fold and unfold accurately.

The present invention has for its object to overcome these difficulties and remedy to these drawbacks.

To this end, the invention concerns a new packaging and conditioning material stock comprising a continuous length of flexible tubular sheath having multiple folds alternatively at each end, forming concentrically superimposed layers of annular plies of sheath.

In order that the invention may be more clearly understood, reference will now be made to the accompanying drawings which show some embodiments thereof by way of example. In the drawings.

Figure 3:
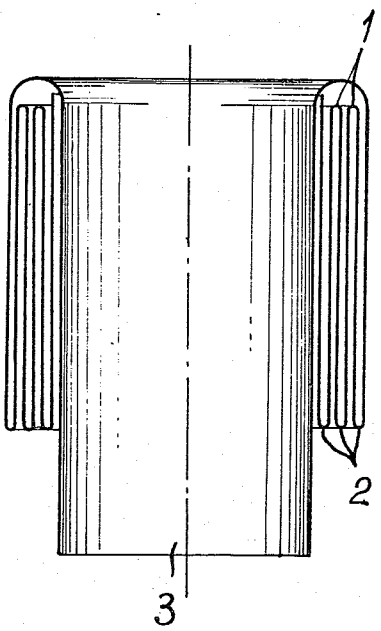
FIGS. 1 to 3 are schematic views in section showing three modifications of the packaging stock according to the invention.
Figure 2:
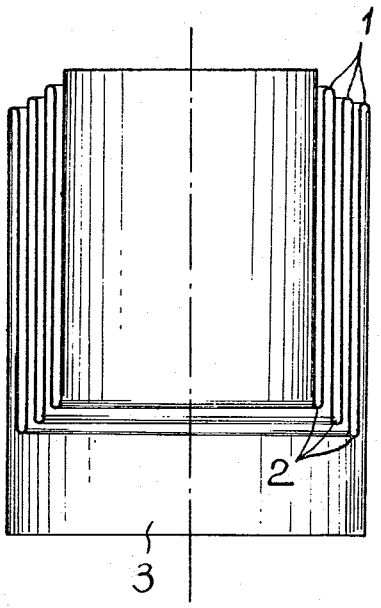
Figure 1:
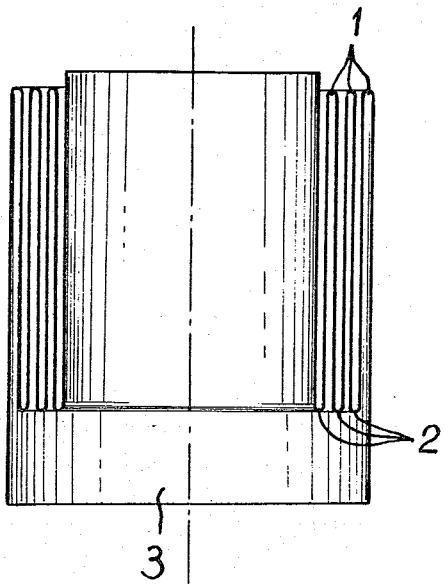

Referring now to FIGS. 1 to 3, therein is shown a packaging and conditioning stock according to the invention and comprising a continuous length of tubular sheath which is folded several times, alternatively at each end, to provide the total length of sheath in a very small volume.

According to the modification shown FIG. 1, the superior (or "head") folds 1 and the inferior (or "tail") folds 2 are at the same heights.

The end 3 of the sheath which is on the outer side of the product is the "head" end which will be used firstly as explained hereunder and is beyond folds 2 to facilitate use.

According to the modification of FIG. 2, the folds are staggered along the axis of the material to facilitate its unrolling under the control of braking means which are provided on the apparatus which will be described later.

According to the modification of FIG. 3, the "head" end 3 is folded reversely with respect to the "tail" folds 1 and is inserted over said folds 1 into the interior of the material. In the case the end 3 goes beyond the "head" folds 2 to be used first.

The length of sheath so folded can be stocked and handled and used as such or it can be disposed upon a rigid mandrel, for example, of cardboard. In both cases it can be used upon a filling machine of any known type comprising a feeding chute for the products to be filled.

Said machine can be provided, as is well known, with a welding and cutting device acting transversally to the axis of the sheath to form separate packages which are extracted one by one from the length of sheath.

The fundamental advantage of the invention with respect to the already known length of sheaths which are folded concertina-like is to provide, for a similar volume, at least three more lengths of sheath. According to calculation, theoretically, for a meter of axial length, a stock formed, according to the invention, of sheath of 0.1 mm thickness for 1 centimeter of radial thickness, will have a total length of 100 meters whereas the same sheath formed concertina-like upon the same axial length will have only a 50 meter length.

In practice, it is the difference of total length and much more importantly, the natural tendency of the concertina-like sheath to unfold by itself whereby it can be said that on the same mandrel the Applicant can stock 100 meters of sheath according to the invention whereas only 16 meters of sheath can be folded concertina-like.

Moreover, a further advantage of the invention is the possibility of using a sheath much thicker and more rigid than with a concertina-like fold. As a matter of fact, with heavy or rough products such as refuse, chips, cement and so on, the sheath must be very thick and it has been shown that a concertina-like sheath cannot be used taking account of the friction of the folds upon the chute which is less than the longitudinal traction forces on the sheath, which force is the sum of the weight of the products and of the elasticity of the sheath which has a tendency to unfold the sheath.

It results from the above considerations that the invention provides means not only to stock a much longer length of sheath but moreover to use a filling apparatus in cases where it was up to now not possible and moreover to improve the filling machine to enable a continuous functioning thereof whereas before the invention they could be used only in a discontinuous and manual way.

Said advantages will be clear in the following description of examples of machines which are generally known but which can be used with new advantages when they are improved according to the invention.

In the following examples, the sheath length is placed upon a mandrel but it should be recalled that practically said mandrel can be omitted.

Referring now to the drawings, it can be seen that, in accordance with the invention, a cylindrical mandrel 4, of cardboard for example, is used over which is fitted a tubular sheath 5 which is folded in superimposed annular layers so as to have the greatest possible developed length in comparison with the mandrel 4. Advantageously, it is secured to the mandrel 4 at the top by a member 6 which may be formed as a taper.

At the other end, the sheath 5 is free and extends beyond the former for the short length 3.

To ensure that the sheath 5 unfolds properly layer by layer, a braking mechanism may be used which is formed by one or more assemblies each comprising at least one roller 100 freely mounted on a support 101 which is impelled radially towards the outside of the sheath 5 by a spring 102 which bears on a shoulder 103 on the support 101 and on a support 104 which may be adjustable to regulate the tension of the spring 102.

Figure 5:
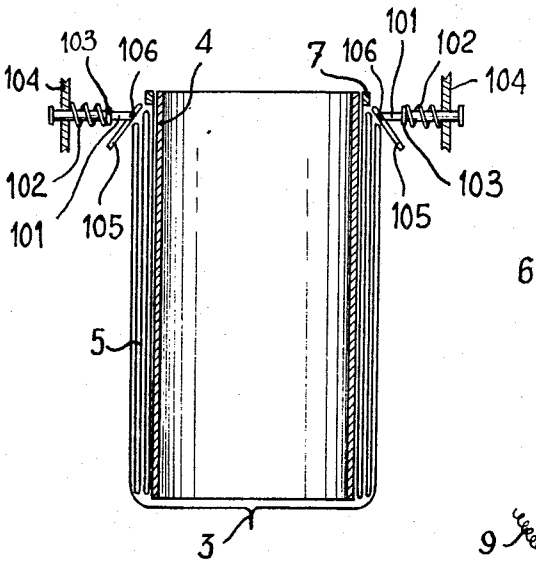
FIG. 5 shows a machine provided with a sheath with staggered layers.

FIG. 5 shows how the sheath of FIG. 2 with successive layers staggered in the direction of the generatrix is used.

Figure 4:
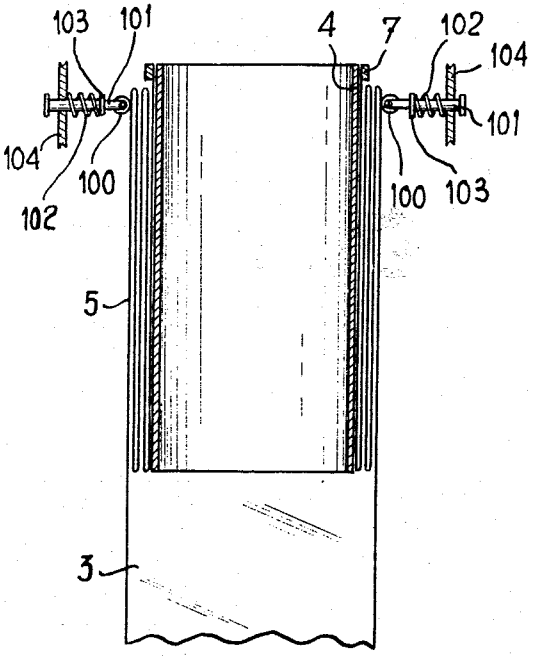
FIG. 4 is a sectional view showing a machine provided, according to the invention, with a sheath arranged in superimposed annular layers.

In this case, the braking mechanism is similar to that shown in FIG. 4, but the roller is replaced by a shoe 105 which is mounted on a pivot 106. The latter is situated at the end of the support 101 and is nearer the upstream end of the shoe 105 than its downstream end.

In this way, the shoe automatically takes up a position in accordance with the slope of the staggered layers of the sheath 5 and, moreover, the pressure of the spring 102 is transmitted in such a way that the pressure is greater against the last layer than against the others. The layers thus unfurl in the correct order.

The mandrel 4 is intended to fit onto a chute 7 which communicates with the infeed for the products to be packed and which is situated above a mechanism 8 (known per se) which enables the sheath 5 to be welded transversely along two parallel lines and which enables the sheath to be cut between these two weld lines.

This known mechanism 8 comprises two jaws 8*a* and 8*b* which may be moved apart or together and which are connected by cables 9 to a high-frequency current source which heats the welding heads which come into contact with one another through the sheath 5.

A cutting device, which is also known per se, enables the sheath to be cut off between the two weld lines so produced.

When this operation has been carried out, the two jaws 8*a* and 8*b* move apart and the downstream part of the sheath 5 which is filled with the product is separated from the rest of the sheath 5.

Figure 6:
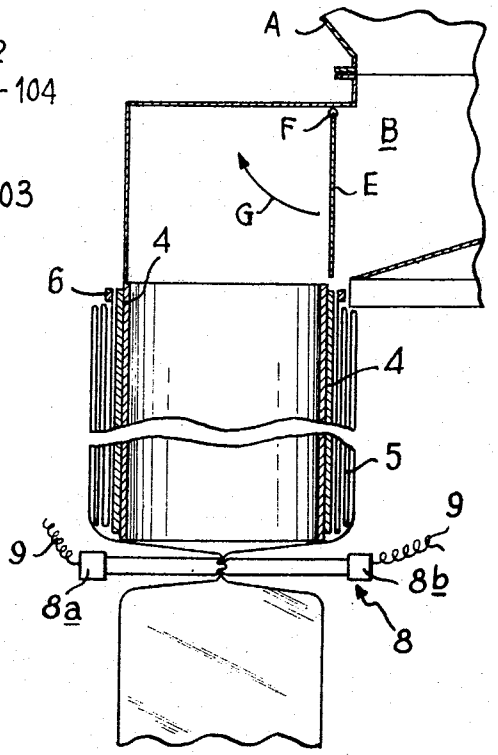
FIG. 6 is a schematic view of a first embodiment of machine according to the invention.
Figure 7:
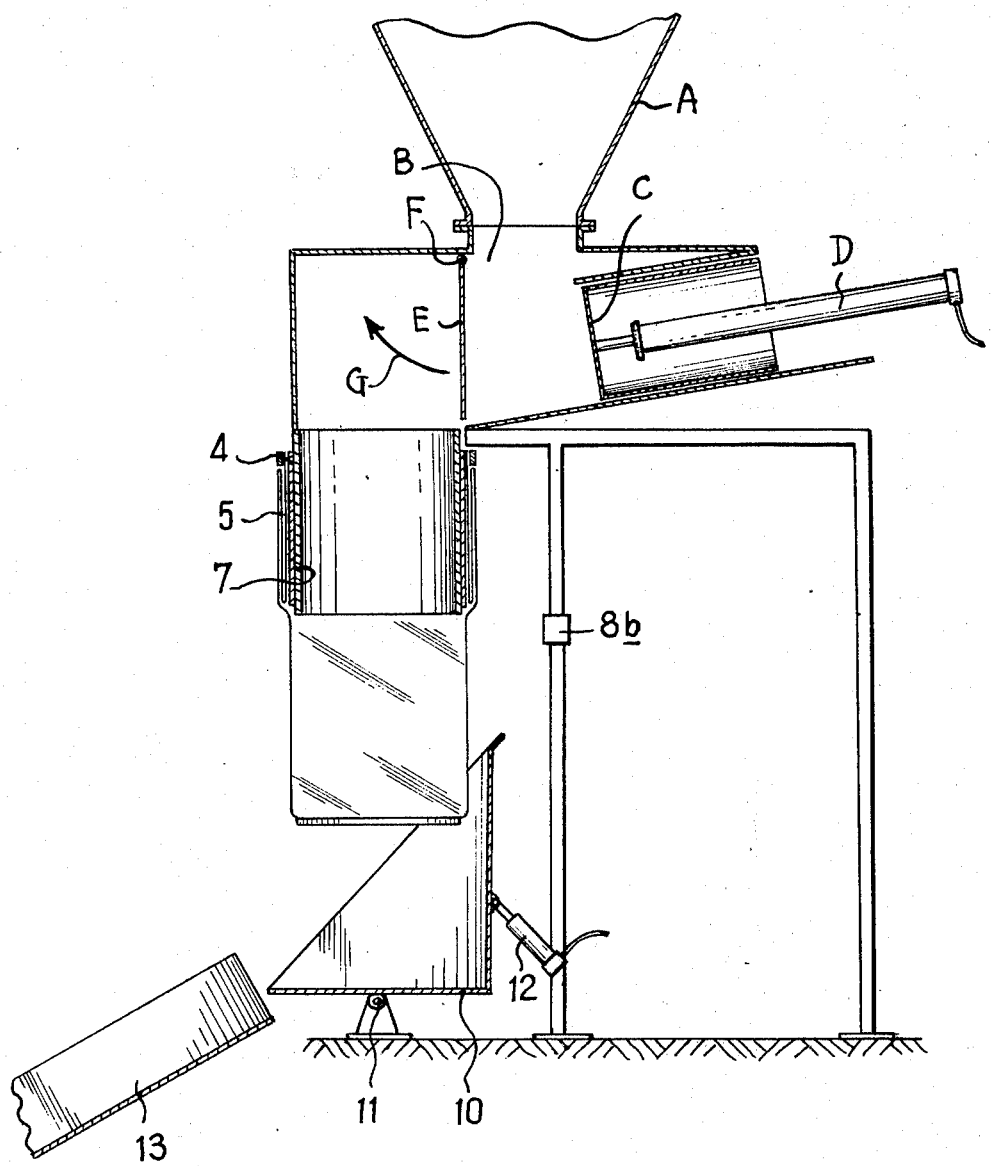
FIG. 7 is a partial view of the machine of FIG. 5 showing how a full container is produced.

To illustrate the invention, the case of packaging and discharging household rubbish has been selected here and FIGS. 6 and 7 show a device for compacting this rubbish, which is known per se, but which will be further described for completeness.

The rubbish, which is thrown in bulk into a so-called "waste disposal" tube arrives via a funnel A in the chamber B of the apparatus, the latter receiving a pusher C moved by a ram D. On the opposite side from the pusher C is a gate E hinged at the top to an axle F and associated with members (not shown) intented to hold the gate E in position against the pressure which it receives from the ram D which compresses the rubbish against it.

At the desired moment, the gate E opens and rises in the direction of arrow G while the ram D continues on its way and the pusher C forces the rubbish to fall into the chute 7.

The operation of the ram D is cyclic and the rubbish is compressed in batches each corresponding substantially to the volume of the chamber B.

According to the embodiment of FIGS. 6 and 7, the compacted rubbish coming from the chamber B falls through the chute 7 and on to the pre-sealed bottom of the end 3 of the sheath 5. The weight of this rubbish thus acts directly on the bottom of the sheath 5 and the latter unfolds automatically from the mandrel 4 each time a volume of rubbish arrives through the chute 7.

The sheath 5 thus unfolds bit by bit until it reaches a platform 10 which is situated at a level corresponding to the height of the sacks required relative to the open end of the chute 7.

At this moment, a sensing member (not shown) causes the jaws 8*a* and 8*b* to close to seal the filled bag and, at the same time, to separate the bag from the rest of the sheath 5, which is then located in the original position with a transverse weld forming the bottom of the next bag.

As soon as the welds and the cut have been made, the jaws 8*a* and 8*b* open so that the filled bag now rests only on the platform 10, this being mounted on a horizontal axle 11 and being acted on by a ram 12. Fluid pressure is built up in this ram 12 so that its piston causes the platform 10 to tilt about axle 11, which causes the filled bag to fall onto an inclined trough 13 which leads to a storage or final disposal area.

When the full length of sheath 5 contained on the mandrel 4 is used up, this mandrel is removed and replaced by a fresh mandrel provided with sheath 5.

To detect the end of the sheath 5, either a contact sensor may be used which senses the presence of the folded sheath to a predetermined depth on the mandrel 4 or, more simply, a counter may be used which measures the number of strokes performed by the ram D of the compactor.

In effect, the volume that a given length of sheath on the mandrel 1 represents is known exactly and the volume of rubbish discharged is also known from the number of strokes of the ram D.

The contact sensor or the counter counting the strokes of the ram D is connected to any known automatic stop mechanism for the apparatus and, if desired, also to a warning mechanism.

It can thus be seen that the operating cycle is entirely automatic and that the sheath 5 which is folded onto the mandrel 4 enables a specific number of filled bags to be obtained in succession.

Referring now to FIGS. 8 to 12, a device for compacting products to be packed is shown therein, which is made in a different way from that in FIGS. 6 and 7.

In this case, the chamber and the chute form extensions of one another on a substantially horizontal axis.

The products are introduced into the apparatus through an upper infeed 14 which is equipped, in a manner known per se, with a sensor comprising a photoelectric cell 15 and a reflector 16.

The chute 7 is horizontal, as stated above, and is an extension of a cylindrical part 17 in which a cylinder 18 can slide, the base 19 of which forms a pusher for the products and is acted on by the piston 20 of a ram 21.

The cylinder 18 is guided by the part 17 and by the chute 7, a sealing ring 22 being fixed to the cylinder 18.

Once again, the jaws 8*a* and 8*b* of the mechanism 8 are situated downstream of the chute 7.

Downstream of this mechanism 8 is a plate 23 which is transverse to the axis of the chute and which is connected to the piston 24 of a ram 25 so that it can take up two positions, one being an operating position opposite the chute 7, and the other a withdrawn position away from this chute 7.

The plate 23 slides in guides 26, the purpose of which is also to hold it rigidly in position at right angles to its plane.

Finally, downstream of the plane 23 and the guides 26 is a receiving platform 27.

This disposition is practically possible only thanks to the packaging and conditioning materials stock according to the invention, since, otherwise, the length of this would not be sufficient to provide an automatic operation for several hours as it would be the case when a concertina-like sheath would be used. It is obviously not possible to use separate bags, since they should be changed one by one and each time, a quantity of products would fall out of the bag.

To prevent the piston 20 and the ram 21 being of excessive length, two coupled, in-line rams may be used.

The base of the ram 21 has a flange 28 connected by bolts to a flange 29 secured to a second ram 30, the piston 31 of which is connected to the fixed bottom of the cylindrical part 17.

In conjunction with the first ram 21, this second ram 30 forms the mechanism for discharging the products, the ram 21 alone acting to compress the product.

This device operates in the following way:

The products which arrive through the infeed 14 fall into the apparatus in front of the face of the cylinder 19.

When the light beam from the cell 15 is no longer reflected by the reflector 16, the products have arrived at the level of this light beam, the beam being situated at a suitable height to give the desired volume to the batch of products to be compressed.

Figure 9:
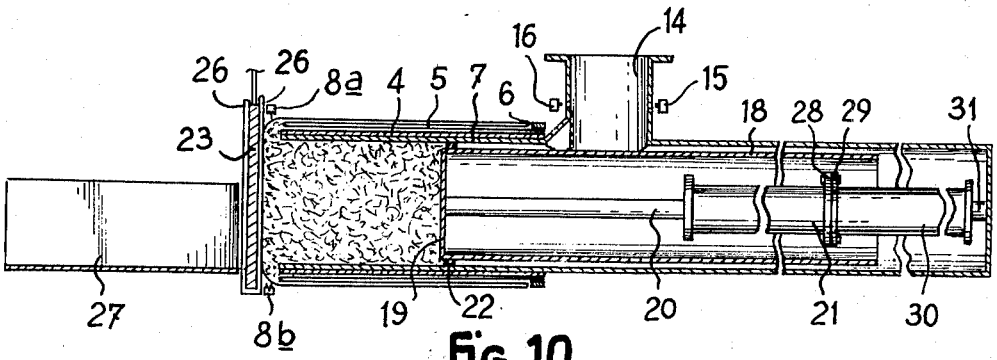

The cell 15 then causes the ram 21 to operate, the piston of which acts on the cylinder 18 to push the products along the chute 7 into the bottom, which has previously been welded, of the sheath 5. The products are pressed against the plate 23 through the bottom of the sheath 5 and the latter is therefore not subjected to any force liable to damage it (FIG. 9).

Figure 8:
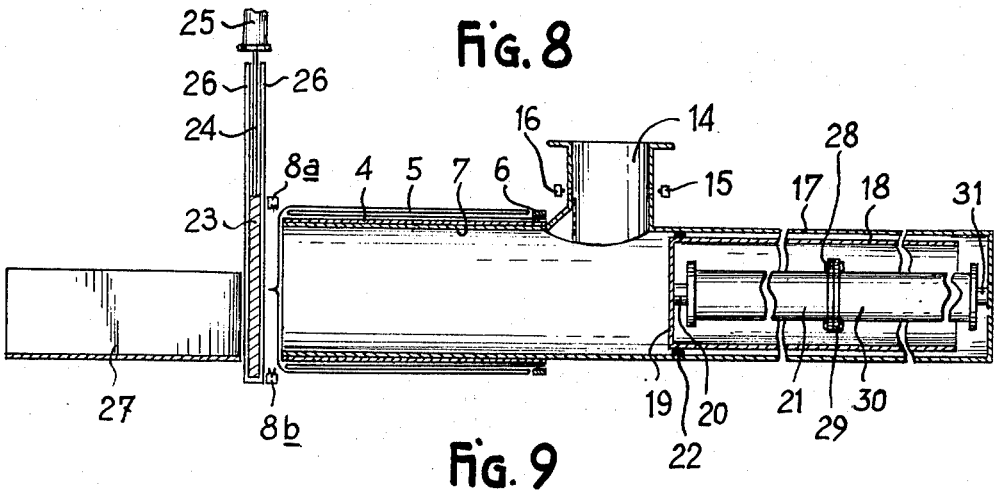
FIGS. 8 to 12 show schematically, in section, a second embodiment of the invention at different stages of operation.

When the products are sufficiently compressed, the fluid pressure in the ram 21 is reversed so that piston 20 and cylinder 18 come back to their original position (FIG. 8).

Figure 10:
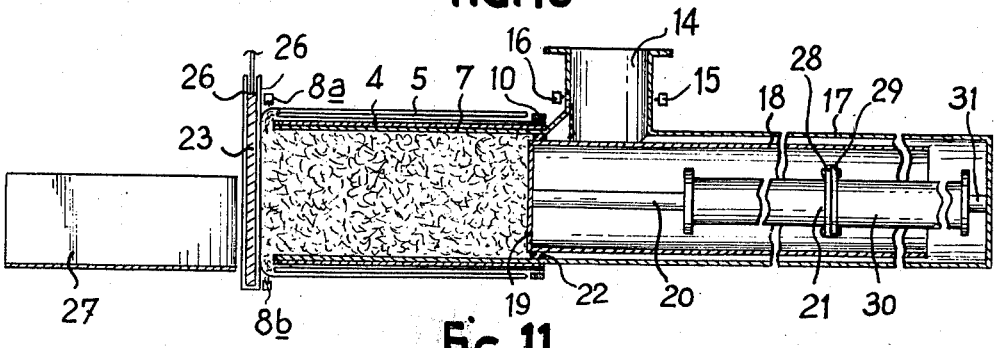

The cycle continues until the whole space in the tube 7 is filled with compacted products (FIG. 10).

To arrive at this desired volume, a member which senses the stop position of the piston 20 at the entry to the chute 7 may be used, or, more simply, a counter which counts the strokes of this piston 20 may be used.

Figure 11:
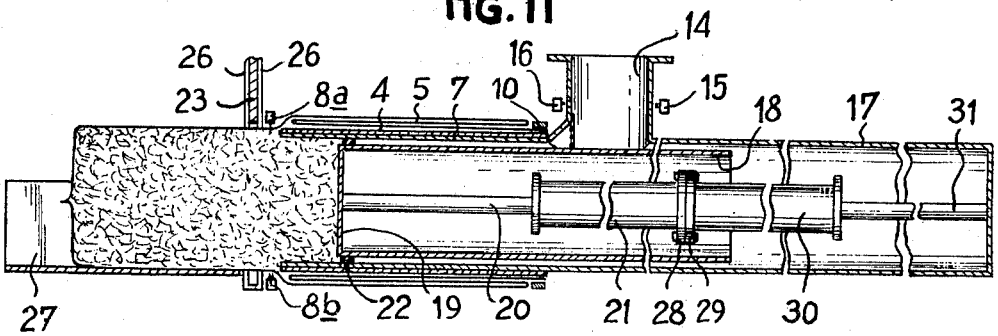

When the chute 7 is completely filled, the piston 20 is held for a few moments in the position in FIG. 10 and the ram 25 is pressurized so that its piston 24 comes into its withdrawn position, taking with it the plate 23 which slides in the guides 26 and thus assumes its withdrawn position (FIG. 11).

As soon as the plate 23 has reached this position, pressure is built up in the ram 30 which then moves since its piston 31 is buttressed against the fixed bottom.

The length of the piston 31 is therefore added to that of the piston 20 and the two coupled rams push all the products past the plate 23, taking with them the sheath 5, one layer of which is withdrawn from the mandrel 4.

Figure 12:
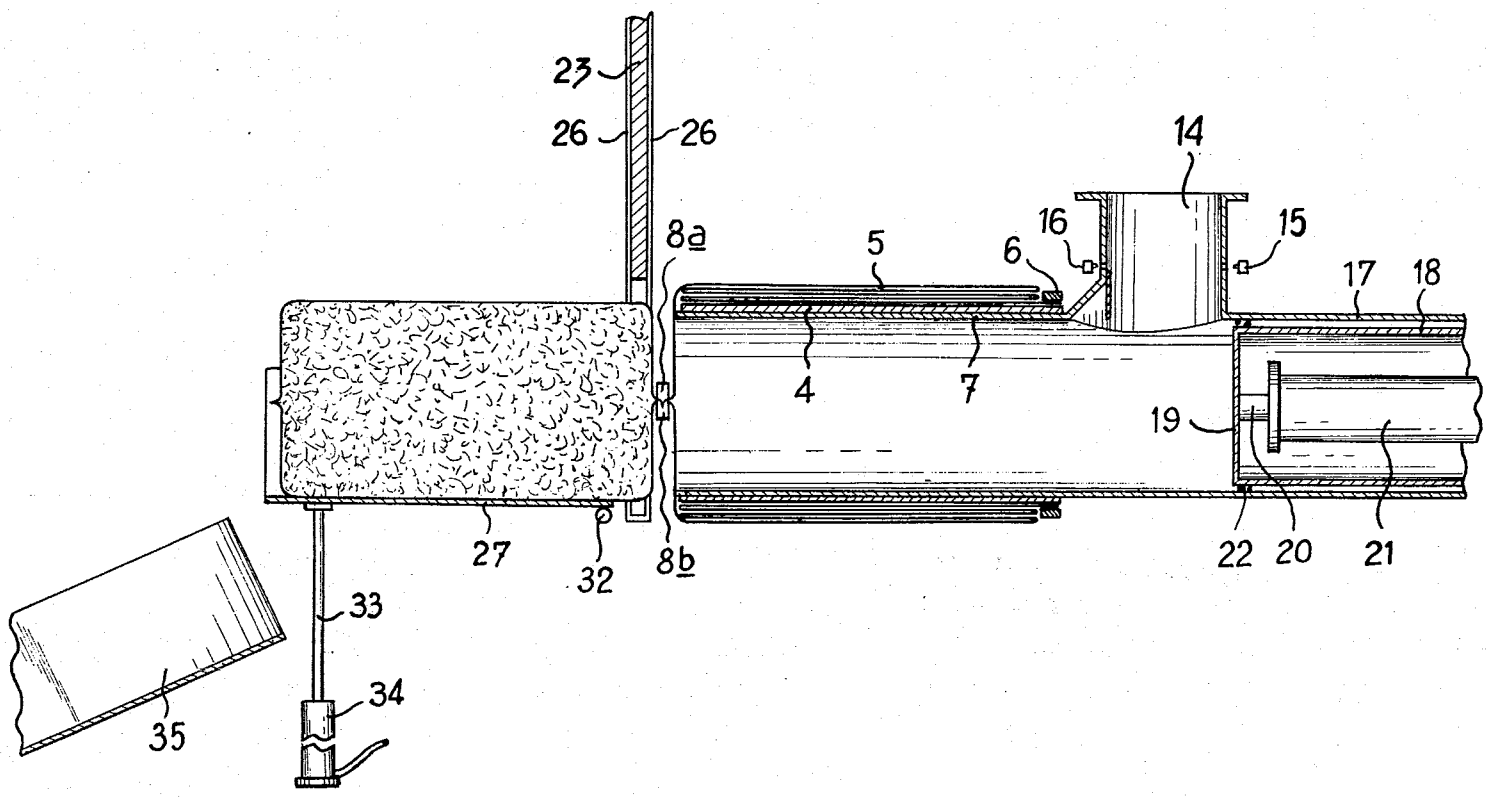

Having arrived at the end of their travel, the two pistons 20 and 31 have their fluid pressure reversed to retract them in the rams 21 and 30, which thus return to their withdrawn position (FIG. 12). At this moment, the jaws 8*a* and 8*b* close to weld the sheath 5 together transversely, as was explained above.

The filled section of sheath then rests on the platform 27 and the cycle starts again.

This platform 27 may be horizontal and continuous so that the last full bag is pushed along by the next bag which is expelled from the chute 7. The length of the platform 27 then corresponds to a certain number of already packed bags and may be the same as the developed length of the sheath 5 located on a mandrel 4.

It is also possible, as shown in FIG. 12, to mount the platform 27 about a horizontal axis 32 while, at the other end, the platform 27 receives the piston 33 of a ram 34. The piston 33 is normally in its extended position to hold the platform 27 in position to accept the bags which are being filled. As soon as this seal is produced and the jaws 8*a* and 8*b* are again open, the pressure in the ram 34 is built up in the opposite direction so that the piston 33 assumes a withdrawn position, which causes the platform 27 to tilt about its axis 32.

The bag which is resting on the platform 27 then falls by gravity into an inclined passage 35 which leads to a storage or final disposal area.

It can be seen that the device which is shown in FIGS. 8 to 12 is mainly distinguished from that in FIGS. 6 and 7 by the fact that, in this case, the chute 7 is of a length substantially equal to that of the bag which it is desired to obtain, so that the sheath 5 unfolds from this mandrel 4 all in one movement when all the already compressed materials is discharged (FIG. 11).

The device in FIGS. 6 and 7 has been shown with a chute having a vertical axis while the device in FIGS. 8 to 12 has a chute arranged along a horizontal axis.

It goes without saying that, in the case of the device in FIGS. 6 and 7, it is indispensable for the axis of the chute 7 to be vertical (or substantially vertical, that is to say inclined) since it is the inherent weight of the products which cause, as they are fed in, the step by step unfurling of the sheath 5.

Conversely in the device in FIGS. 8 to 12, it is the positive action of the rams 21 to 30 which cause the products to be compacted and the filled bag to be discharged.

Therefore, it is not indispensable in this case for the chute 7 to be horizontal. In fact, it can assume any inclination whatever, including being vertical. In order that the mandrel 4 remains secured to the chute 7 despite the traction exerted on the sheath 5, provision may be made for the chute 7 to be substantially frustoconical so that the mandrel 4, which is cylindrical, is wedged to some degree.

In the case of FIGS. 6 and 7 the weight of the product rests on the bottom of the sheath 5 and it could happen that when the first batch of product arrives, the sheath 5 unfurls completely until the bottom of it reaches the platform 10.

This is of no significance in itself if the unfolded portion of the sheath 5 remains tensioned.

In order to prevent any faulty tensioning of the sheath 5, it may be advantageous to make provision for a mechanism for braking the sheath on the mandrel 4.

It is, for example, possible to use jaws which move apart when the full mandrel 4 is placed in position and which are held closed while the device is operating in such a way that they act perpendicularly to the mandrel 4 so that the lower part of the sheath 5 is to some extent grasped between the mandrel 4 and the jaws.

In order that the sheath 5 shall not be torn or damaged, the end of the jaws may carry free-mounted rollers.

Provision may be made also for the chute 7 to be of a length substantially greater than that of the mandrel 4, the lower portion of this chute 7 then extending beyond the mandrel 4 when the latter is in place. Free-mounted rollers may be positioned on this projecting part of the chute 7 which co-operate with the rollers on the jaws. Whichever embodiment is selected, the device advantageously includes an automatic control mechanism which enables the apparatus to function continuously in the desired cycle for the various successive operations.

This automatic control mechanism therefore causes the jaws 8*a* and 8*b* to close to form the bottom of the first bag to be produced. The same mechanism prevents the ram D from acting until this operation is completed and releases the ram D as soon as the first bottom is formed.

The action of the ram D depends of the volume of product entering the chamber B, as is already known per se; so that the next automatic operation consists in causing the jaws 8*a* and 8*b* to close to seal the first filled bag as soon as the member which senses the volume arrived at comes into action, and then in causing the platform 10 to tilt as soon as the jaws 8*a* and 8*b* have returned to their withdrawn position.

In the case of the embodiment of FIGS. 8 to 12, the automatic control mechanism causes the following operations to take place successively: the jaws 8*a* and 8*b* close and the same jaws then open, then the ram 21 acts in accordance with a signal received by the photoelectric cell 15, then the piston 20 stops in the required position when the space in the chute 7 is full, whereafter the plate 23 withdraws and the ram 30 extends until the filled bag is completely discharged from the chute 7, then the pistons 20 and 21 return to the withdrawn position, the jaws 8*a* and 8*b* close and re-open, and then the plate 23 returns to its operating position and so on.

For obvious reasons of safety it is necessary for the plate 23 to be in its operating position before the piston 20 can compress the products.

It is for this reason that the plate 23 acts on a contact which by-passes the photoelectric cell 15 as long as the plate is in the withdrawn position, whereas this cell 15 is put back in circuit as soon as the plate 23 has regained its operating position.

It can be seen from the above description that not only is the packaging of the products entirely automatic, using simple and unsophisticated means, but moreover, the products are never in contact with the atmosphere, either before being introduced into the apparatus during packaging, or when leaving the apparatus.

In fact, the products are only introduced into the chute if the bottom of the sheath is sealed, so that the circuit is permanently sealed, which is particularly valuable for dangerous or unwholesome materials such as household waste which, in this way, no longer give rise to any sort of pollution.

It will be clear that the invention may be applied to packaging products other than household waste and the sealed nature of the apparatus may then be particularly appreciated if the materials are dangerous chemical products or ones which give off unpleasant gases.

The modification shown FIG. 3 is particularly advantageous since the products are even not in contact with the chute 4. This modification is specially adapted to the discharge and packaging of domestic refuses as in small kitchen appliances since no spots and therefore no smells are to be feared.

What I claim is:

1. A packaging material comprising a flexible tubular sheath adapted to be cut into independent package units of given length, said sheath having opposite open ends and being folded onto itself at one of said ends with alternating opposite annular folds to form a plurality of concentric annular plies superposed on one another in a direction perpendicular to the axis of the sheath, said plies being independently withdrawable in succession axially of said sheath and all having substantially the same length equal to that corresponding to one said package unit.

2. A packaging material as claimed in claim 1 in which said annular plies are staggered in the axial direction.

3. A packaging material as claimed in claim 1 in which the end of the length of sheath closer to the outermost ply is folded over said plies and extends through the innermost ply.

4. A packaging material as claimed in claim 1 which is disposed on a rigid mandrel.

5. A packaging material as claimed in claim 1 wherein one set of folds of the sheaths is aligned at a first level and the other set of folds of the sheath is aligned at a second level, the axial spacing between the first and second levels being equal to the length of each ply.

* * * * *